US011944252B2

(12) United States Patent
Gaus

(10) Patent No.: US 11,944,252 B2
(45) Date of Patent: Apr. 2, 2024

(54) CLEANING SYSTEM AND METHOD FOR CLEANING ITEMS TO BE CLEANED

(71) Applicant: MEIKO Maschinenbau Gmbh & Co. KG, Offenburg (DE)

(72) Inventor: Bruno Gaus, Offenburg (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 544 days.

(21) Appl. No.: 17/250,671

(22) PCT Filed: Aug. 19, 2019

(86) PCT No.: PCT/EP2019/072155
§ 371 (c)(1),
(2) Date: Feb. 18, 2021

(87) PCT Pub. No.: WO2020/038893
PCT Pub. Date: Feb. 27, 2020

(65) Prior Publication Data

US 2021/0267431 A1 Sep. 2, 2021

(30) Foreign Application Priority Data

Aug. 22, 2018 (DE) ..... 102018214167.3

(51) Int. Cl.
*A47L 15/24* (2006.01)

(52) U.S. Cl.
CPC ..... *A47L 15/241* (2013.01); *A47L 2401/04* (2013.01); *A47L 2501/36* (2013.01)

(58) Field of Classification Search
CPC . A47L 15/241; A47L 2401/04; A47L 2501/36
See application file for complete search history.

(56) References Cited

U.S. PATENT DOCUMENTS 3,232,425 A * 2/1966 Le Van Hansen ..... B03B 9/06 134/131
6,959,714 B1 11/2005 Hakansson et al.
(Continued)

FOREIGN PATENT DOCUMENTS

DE 102004049392 A1 4/2006
DE 102004056052 A1 6/2006
(Continued)

OTHER PUBLICATIONS

PCT, Intl. App. No. PCT/EP2019/072155, International Preliminary Report on Patentability, 8 pages, dated Feb. 25, 2021.
(Continued)

*Primary Examiner* — Natasha N Campbell
(74) *Attorney, Agent, or Firm* — Woodard, Emhardt, Henry, Reeves & Wagner, LLP

(57) ABSTRACT

A cleaning system (110) and a method for cleaning items to be cleaned (112) are proposed. The cleaning system (110) comprises:

a) at least one cleaning apparatus (114), having at least one at least partially closed cleaning chamber (116) with at least one loading apparatus (118) for loading the items to be cleaned (112) with at least one cleaning liquid; and b) at least one transport system (144) for the automatic transport of the items to be cleaned (112), the transport system (144) comprising:

a. at least one first conveying apparatus (146) for the delivery of dirty items to be cleaned (112);

b. at least one second conveying apparatus (148) for the transport of the dirty items to be cleaned (112) to the cleaning apparatus (114);

c. at least one transfer apparatus (150) for the transfer of at least one part of the dirty items to be cleaned (112) from the first conveying apparatus (146) onto the second conveying apparatus (148); and (Continued)

d. at least one buffer store (152) for the buffer storage of at least one part of the dirty items to be cleaned (112), the transfer apparatus (150) being set up to selectively transfer the dirty items to be cleaned (112) from the first conveying apparatus (146) directly onto the second conveying apparatus (148), or to buffer store them in the buffer store (152) and to subsequently transfer them onto the second conveying apparatus (148).

15 Claims, 4 Drawing Sheets

(56) References Cited

U.S. PATENT DOCUMENTS

| | | | | |
|---|---|---|---|---|
| 7,325,667 | B1 | 2/2008 | Damick et al. | |
| 2007/0246071 | A1 | 10/2007 | Streb | |
| 2009/0183753 | A1 | 7/2009 | Maennle et al. | |
| 2010/0043834 | A1 | 2/2010 | Schenringer | |
| 2010/0132735 | A1 | 6/2010 | Gaus et al. | |
| 2013/0319828 | A1* | 12/2013 | Disch | B65G 17/002 198/836.1 |
| 2019/0167065 | A1 | 6/2019 | Yoon et al. | |
| 2020/0253453 | A1 | 8/2020 | Disch et al. | |

FOREIGN PATENT DOCUMENTS

| | | | |
|---|---|---|---|
| DE | 20023832 | U1 | 11/2006 |
| DE | 102007025263 | A1 | 10/2007 |
| DE | 102017121978 | A1 | 11/2017 |
| EP | 2158833 | A2 | 3/2010 |
| JP | H06135549 | A | 5/1994 |
| JP | H06295896 | A | 10/1994 |
| JP | H11139539 | A | 5/1999 |
| JP | 2006038881 | A | 2/2006 |
| WO | 2001034015 | A1 | 5/2001 |
| WO | 2012173479 | A1 | 12/2012 |
| WO | 2018034251 | A1 | 2/2018 |

OTHER PUBLICATIONS

PCT, Written Opinion, Intl. App. No. PCT/EP2019/072155, 7 pages, dated Dec. 13, 2019.

PCT, International Search Report, Intl. App. No. PCT/EP2019/072155, 4 pages, dated Dec. 13, 2019.

* cited by examiner

CLEANING SYSTEM AND METHOD FOR CLEANING ITEMS TO BE CLEANED

TECHNICAL FIELD

The invention relates to a cleaning system and to a method for cleaning items to be cleaned. Cleaning systems and methods of the indicated type can be used, for example, in the field of dishwashing technology, in particular in the field of commercial dishwashing technology. Thus, in particular, the invention can be used in large kitchens, in which items to be cleaned, for example trays, dishes and cutlery, have to be cleaned in relatively large quantities. Other fields of use are also fundamentally conceivable, however.

TECHNICAL BACKGROUND

A multiplicity of cleaning apparatuses (also called cleaning units) are known from the prior art, which cleaning apparatuses can clean and/or disinfect items to be cleaned. The configuration of said cleaning apparatuses is greatly dependent overall on the various boundary conditions, such as, for example, the type of items to be cleaned, the types of contamination, the throughput or similar conditions. Reference can be made by way of example to cleaning apparatuses which are described, for example, in DE 10 2004 056 052 A1 or in DE 10 2007 025 263 A1.

In many cases, cleaning apparatuses are combined in large kitchens with transport apparatuses or transport systems for the automatic delivery and/or removal of the items to be cleaned. Thus, for example, in many establishments for communal catering, such as, for example, canteens in schools, hospitals or other establishments, in which a multiplicity of persons are catered for, cleaning systems are provided, in the case of which trays with dirty dishes and cutlery are placed onto a transport belt. The latter transports the items to be cleaned to the actual cleaning apparatus, such as, for example, a dishwasher. There, the items to be cleaned are as a rule still sorted with the use of staff, trash is disposed of, and dishes, cutlery and trays are fed in a suitable way to the cleaning apparatus, for example a belt transport dishwasher, a rack transport dishwasher or else a hood-type dishwasher. In many cases, despite the transport system, manual work is therefore still required in the case of the feeding of the dirty items to be cleaned into the cleaning apparatus and/or also in the case of the removal of the cleaned items to be cleaned from the cleaning apparatus.

Here, in many cases, a technical and also organizational challenge consists in that the dirty items to be cleaned do not accrue in a homogeneous manner Peak loads frequently occur, in particular, on account of group dynamics, timetables or else other circumstances which do not lie within the sphere of influence of the large kitchen, as do likewise times, in which only a small amount of or even no items to be cleaned accrue. As a rule, the manpower planning has to be configured, however, in such a way that the staff is adequate for the peak loads, which leads, however, to an insufficient utilization of the staff outside the peak loads under certain circumstances. The manpower planning therefore has to be configured to be excessive in many cases.

DE 10 2017 121 978 A1 describes a dishwasher in the form of a commercial utensil or crockery dishwasher which is designed as a programmable machine, is configured as a hood-type or pass-through dishwasher, and has a treatment chamber with at least one washing system which is configured as a recirculation system. In order to achieve a situation where the utilization of the machine which can actually be realized can be optimized, to be precise in the case of simultaneous relieving of the dishwashing staff, it is provided according to the invention that the dishwasher is assigned a loading/unloading apparatus, for the preferably optional automatic loading of the treatment chamber with items to be washed and/or for the preferably optional automatic unloading of items to be washed from the treatment chamber.

DE 10 2004 049 392 A1 describes a method for transporting items to be cleaned through a pass-through dishwasher and onto a pass-through dishwasher. The pass-through dishwasher comprises a washing zone, a rinsing zone and a drying zone. The items to be cleaned are cleaned in the washing zone, are rinsed in the rinsing zone, and are dried in the drying zone. Transport devices are provided, by way of which the items to be cleaned are transported in the conveying direction at a transport speed which is optimum for the process steps which take place in the respective zones.

Despite the advantages which are achieved by way of said apparatuses and methods, the above-described technical and organizational challenge persists as a rule. The manpower planning for many cleaning systems still has to be dimensioned in such a way that it withstands a peak load in every case.

OBJECT OF THE INVENTION

Therefore, it would be desirable to provide a cleaning system and a method for cleaning items to be cleaned, in particular items to be cleaned in the area of large kitchens, which at least largely avoid the disadvantages of known apparatuses and methods of the indicated type. In particular, the cleaning system and the method are to make more flexible manpower planning with regard to the operating staff possible and are preferably to reduce the use of operating staff.

DISCLOSURE OF THE INVENTION

Said object is addressed by way of a cleaning system and a method for cleaning items to be cleaned, with the features of the independent patent claims. Advantageous developments which can be realized individually or in any desired combination are shown in the dependent claims.

In the following text, the terms "have", "exhibit", "comprise" or "include" or any desired grammatical deviations therefrom are used in a non-exclusive way. Accordingly, said terms can relate both to situations, in which, in addition to the features which are introduced by way of said terms, there are no further features, or to situations, in which there are one or more further features. For example, the expression "A has B", "A exhibits B", "A comprises B" or "A includes B" can relate both to the situation, in which, apart from B, there is no further element in A (that is to say, to a situation, in which A consists exclusively of B), and also to the situation, in which, in addition to B, there are one or more further elements in A, for example element C, elements C and D, or even further elements.

Furthermore, it is noted that the terms "at least one" and "one or more" and grammatical modifications of said terms, if they are used in conjunction with one or more elements or features and if they are to express that the element or feature can be provided in a singular or multiple manner, are as a rule used merely once, for example in the case of the first introduction of the feature or element. In the case of a subsequent renewed mention of the feature or element, the corresponding term "at least one" or "one or more" is as a rule no longer used, without restriction of the possibility that the feature or element can be provided in a singular or multiple manner.

In the following text, furthermore, the terms "preferably", "in particular", "for example" or similar terms are used in conjunction with optional features, without alternative embodiments being restricted as a result. Features which are introduced by way of said terms are thus optional features, and it is not intended for the scope of protection of the claims and, in particular, of the independent claims to be restricted by way of said features. Thus, as a person skilled in the art will recognize, the invention can also be carried out with use of other refinements. In a similar way, features which are introduced by way of "in one embodiment of the invention" or by way of "in one exemplary embodiment of the invention" are understood to be optional features, without it being intended for alternative refinements or the scope of protection of the independent claims to be restricted as a result. Furthermore, by way of said introductory expressions, all possibilities of combining the features which are introduced by way of them with other features, whether optional or non-optional features, are to remain unaffected.

In a first aspect, a cleaning system for cleaning items to be cleaned is proposed. As componfsents, said cleaning system comprises at least one cleaning apparatus and at least one transport system.

As used here, the term "cleaning system" is a broad term which is to be given its customary and common meaning, as understood by a person skilled in the art. The term is not restricted to a specific or adapted meaning. Thus, a "system" can be understood generally to mean an apparatus or a group of interacting apparatuses which are set up in order to fulfill at least one common purpose. Accordingly, the term "cleaning system" can relate without restriction, in particular, to a system which is set up to carry out at least one cleaning operation, that is to say to free items to be cleaned completely or partially from adhering dirt and/or microbial contaminants.

As used here, the term "transport system" is likewise a broad term which is to be given its customary and common meaning, as understood by a person skilled in the art. The term is not restricted to a specific or adapted meaning. The term can relate without restriction, in particular, to a system in the sense of the above definition, which system serves for the transport of one or more elements or objects, such as, in particular, the transport of items to be cleaned, for example, in the present case.

As used here, the term "cleaning apparatus" is a broad term which is to be given its customary and common meaning, as understood by a person skilled in the art. The term is not restricted to a specific or adapted meaning. The term can relate without restriction, in particular, to an apparatus which is set up to free items to be cleaned from adhering macroscopic or else microscopic contaminants or to eliminate contaminants of this type at least partially. In addition, a disinfection effect can optionally be carried out. As will be described below in greater detail, the cleaning apparatus can be configured, in particular, as a dishwasher, in particular as a crockery dishwasher. Here, the dishwasher can be configured, for example, as a single-chamber dishwasher, in particular as a commercial single-chamber dishwasher with a multiple circuit rinsing system, or else as a transport dishwasher, in particular as a belt transport dishwasher and/or as a rack transport dishwasher. Examples will be described in greater detail below.

As used here, the term "items to be cleaned" is a broad term which is to be given its customary and common meaning, as understood by a person skilled in the art. The term is not restricted to a specific or adapted meaning. The term can relate without restriction, in particular, to any desired objects which can be cleaned by means of the cleaning apparatus. Here, one object can be cleaned, or a plurality of objects can be cleaned at the same time or sequentially. In particular, the items to be cleaned can be objects which are used directly or indirectly for the preparation, storage or presentation of meals, that is to say, for example, crockery, cutlery, trays, bowls, glasses, pots, pans or similar objects. Accordingly, the cleaning apparatus can be configured, in particular, as a dishwasher, for example as a dishwasher for commercial use in large kitchens or kitchens for communal catering. Other embodiments of the cleaning apparatus and/or the items to be cleaned are also fundamentally possible.

The cleaning apparatus has at least one at least partially closed cleaning chamber with at least one loading apparatus for loading the items to be cleaned with at least one cleaning liquid.

As used here, the term "cleaning chamber" is a broad term which is to be given its customary and common meaning, as understood by a person skilled in the art. The term is not restricted to a specific or adapted meaning. The term can relate without restriction, in particular, to a completely or partially closed chamber, within which the cleaning operation can be carried out completely or partially. The cleaning chamber can have, in particular, at least one housing which encloses the cleaning chamber completely or partially. Here, a single cleaning chamber can be provided, or a plurality of cleaning chambers can fundamentally also be provided, for example in a sequential manner. The cleaning chamber can have, for example, at least one opening for loading the cleaning chamber with the items to be cleaned. For example, this can be an opening with a flap which is arranged on a front side of the cleaning chamber and/or a top side of the cleaning chamber. As an alternative, hoods for closing off the cleaning chamber are also possible, for example within the context of what are known as hood-type dishwashers. As an alternative, the cleaning chamber can in turn also be configured, for example, completely or partially as a tunnel, for example within the context of what are known as pass-through dishwashers or transport dishwashers, for example as a tunnel with an inlet opening and an outlet opening. Other embodiments are also fundamentally possible.

As used here, the term "loading apparatus" is a broad term which is to be given its customary and common meaning, as understood by a person skilled in the art. The term is not restricted to a specific or adapted meaning. The term can relate without restriction, in particular, to a fundamentally arbitrary apparatus, by means of which the items to be cleaned can be loaded within the cleaning chamber with the cleaning liquid. As will be described in greater detail below, the loading apparatus can comprise, in particular, at least one nozzle system. Furthermore, the loading apparatus can comprise at least one pump, and at least one line system, for the provision of cleaning liquid to the nozzle system. Here, for example, a nozzle system and a line system can be provided for loading with cleaning liquid from a tank, and at least one corresponding pump. As an alternative or in addition, for example, at least one nozzle system can also be loaded directly from a feed line, without a pump being necessary for this purpose. One or more cleaning zones which, for example, are passed through sequentially by the items to be cleaned can be provided in the cleaning apparatus. Thus, for example, a single cleaning zone can be provided, the cleaning apparatus being set up to carry out a cleaning program by means of the loading apparatus, in the case of which cleaning program the items to be cleaned are received in a stationary manner in the cleaning chamber and are loaded with cleaning liquid sequentially in one or more cleaning steps of the cleaning program in a different way. As an alternative, the items to be cleaned can also be transported one after another through a plurality of cleaning zones, in which a different type of loading with cleaning liquid takes place, for example one or more cleaning zones selected from the group consisting of: a pre-clearing zone; a washing zone; a subsequent rinsing zone or rinsing zone, it being possible for said zone to be divided into a pump rinsing zone and a downstream freshwater rinsing zone. Furthermore, at least one drying step can be provided which can be positioned downstream, for example, in the one chamber in the case of stationary receiving of the items to be cleaned for the loading with the cleaning liquid, or which, for example, in the case of the transport dishwasher, can take place in a drying zone which is positioned downstream of the liquid cleaning zones.

As used here, the term "cleaning liquid" is a broad term which is to be given its customary and common meaning, as understood by a person skilled in the art. The term is not restricted to a specific or adapted meaning. The term can relate without restriction, in particular, to a liquid which, when it comes into contact with the items to be cleaned, can develop a cleaning action. In particular, the cleaning liquid can comprise an aqueous liquid, for example water and/or water with one or more additives, for example with one or more detergent concentrates and/or rinse agents and/or disinfectants. The cleaning apparatus can be set up to use a single cleaning liquid or else to use a combination of a plurality of cleaning liquids. If a plurality of cleaning liquids are provided, the loading of the items to be cleaned with the different cleaning liquids can take place at the same time or else sequentially. Thus, for example, the items to be cleaned can remain in a stationary manner within the cleaning chamber and can be loaded one after another with the various cleaning liquids and/or cleaning fluids. As an alternative, as described above, the items to be cleaned can also be transported sequentially through a plurality of cleaning zones, in which, for example, loading with different types of cleaning liquid and/or with cleaning liquids of different degrees of purity takes place. Different degrees of purity can be produced, for example, by way of a cascading overflow between various tanks of the cleaning apparatus, a degree of purity preferably increasing in the transport direction. Pumped systems can also be used which regulate the liquid balance and the degree of purity between the individual tanks of the cleaning apparatus.

The transport system is set up for the automatic transport of the items to be cleaned. Here, an "automatic" transport of the items to be cleaned can be understood to mean, in particular, a transport, in the case of which the items to be cleaned are transported from at least one first location or region toward at least one second location or region, without muscle power being required for the movement of the items to be cleaned. Thus, as will be described in greater detail below, the automatic transport can take place, in particular, with the use of at least one electromechanical transport apparatus, for example with the use of at least one electromechanical drive such as, for example, at least one electric motor.

The transport system comprises:

a. at least one first conveying apparatus for the delivery of dirty items to be cleaned;
b. at least one second conveying apparatus for the transport of the dirty items to be cleaned to the cleaning apparatus;
c. at least one transfer apparatus for the transfer of at least one part of the dirty items to be cleaned from the first conveying apparatus onto the second conveying apparatus; and
d. at least one buffer store for the buffer storage of at least one part of the dirty items to be cleaned.

Here, the terms "first", "second" and possibly further numerations in the following text are used in conjunction with terms as pure nomenclature, without stipulating a sequence or ranking as a result.

As used here, the term "conveying apparatus" is a broad term which is to be given its customary and common meaning, as understood by a person skilled in the art. The term is not restricted to a specific or adapted meaning. The term can relate without restriction, in particular, to an apparatus which is set up to convey the items to be cleaned. In particular, the conveying apparatus can have at least one apparatus, selected from the group consisting of: a conveyor belt; a conveyor chain; a roller or roll system for conveying. The conveying apparatus can also be set up to transport items to be cleaned indirectly, for example in racks. In this case, the racks can be placed, for example, onto sliding rails and can be conveyed by means of a reversing pawl transport system. Combinations of said apparatuses are also possible. Furthermore, the first conveying apparatus and the second conveying apparatus can be of identical or else different configuration.

Dirty items to be cleaned can generally be understood to mean the items to be cleaned which have not been subjected to the cleaning operation by way of the cleaning apparatus, regardless of their actual degree of contamination, for example, by way of food residues. "Delivery" can generally be understood to mean the transport of the dirty items to be cleaned away from at least one feeding point, in particular to the second conveying apparatus or to an optional further conveying apparatus which is connected between the first and the second conveying apparatus.

As indicated above, the second conveying apparatus is set up to transport the dirty items to be cleaned to the cleaning apparatus, for example to an inlet region or feeding region of the cleaning apparatus. As will be described in greater detail below, the cleaning apparatus itself can optionally comprise at least one third conveying apparatus which is set up to transport the items to be cleaned through the cleaning chamber. The cleaning system can be set up to transfer the items to be cleaned from the second conveying apparatus onto the third conveying apparatus, for example by the second conveying apparatus adjoining the third conveying apparatus, with the result that the items to be cleaned are transferred directly or else indirectly from the second conveying apparatus onto the third conveying apparatus. As an alternative, however, the second and third conveying apparatus can also be completely or partially structurally identical, with the result that the second conveying apparatus is also set up to transport the items to be cleaned completely or partially through the cleaning chamber. Thus, for example, the second conveying apparatus can have at least one region outside the cleaning chamber, in which region the items to be cleaned are transferred from the first conveying apparatus onto the second conveying apparatus, and at least one further region within the cleaning chamber, in which further region the items to be cleaned pass through the cleaning chamber.

The second conveying apparatus can also optionally have at least one third region which is positioned downstream of the cleaning chamber, and which can be set up as an outlet for the cleaned items to be cleaned. If, in contrast, the second and the optional third conveying apparatus are of separate configuration, the third conveying apparatus can have, for example, a region upstream of the cleaning chamber, in which region the items to be cleaned are transferred from the second conveying apparatus onto the third conveying apparatus, and at least one further region within the cleaning chamber, in which further region the items to be cleaned pass through the cleaning chamber. Furthermore, the third conveying apparatus can in turn optionally have at least one outlet region which is positioned downstream of the cleaning chamber in the transport direction, in which outlet region the cleaned items to be cleaned can be removed from the third conveying apparatus. Various embodiments are possible, can be recognized by a person skilled in the art on the basis of the present description, and will in part be described in greater detail below.

As used here, the term "transfer apparatus" is a broad term which is to be given its customary and common meaning, as understood by a person skilled in the art. The term is not restricted to a specific or adapted meaning. The term can relate without restriction, in particular, to an apparatus or system which is set up to move or to transfer at least one element from a first apparatus or a first system to at least one second apparatus or at least one second system. Here, this can be, in particular, an automatic transfer apparatus which performs said transfer in a fully automatic manner. Accordingly, in particular, the transfer apparatus can have at least one electromechanical actuator, for example at least one gripper and/or at least one sucker or another type of actuator. Furthermore, as will be described in greater detail below, the transfer apparatus can have at least one positioning system, by means of which the at least one actuator can be positioned spatially, for example in one, two, three or more dimensions. Said positioning system can have, for example, one or more rails, along which the actuator can be moved. For example, an x, y and optionally z-positioning operation can take place. As an alternative or in addition to a positioning operation along Cartesian coordinates, a positioning operation can also take place using defined angular coordinates, for example polar coordinates or cylindrical coordinates. The positioning system can be spatially configured, in particular, in such a way that both the first conveying apparatus, the second conveying apparatus and the at least one buffer store are arranged in a spatial operating range, for example in a movement range, of the positioning system.

As used here, the term "buffer store" is a broad term which is to be given its customary and common meaning, as understood by a person skilled in the art. The term is not restricted to a specific or adapted meaning. The term can relate without restriction, in particular, to an apparatus which is set up to reversibly receive one or more elements and to surrender them again. Said elements can be, for example, of identical or else different type. In particular, as will be described in greater detail below, the buffer store can have at least one stacking apparatus for stacking items to be cleaned, it being possible, for example, for the stacking apparatus to be spring-mounted, with the result that in each case the uppermost piece of the items to be cleaned is held, for example, at an at least approximately constant height. In particular, said stacking apparatus can have, for example, at least one tray stacker and/or at least one crockery stacker. The at least one buffer store can be of stationary configuration, or can optionally also be of movable configuration, by it having, for example, at least one roller system. For example, the buffer store can have at least one tray trolley and/or at least one plate trolley. Other embodiments are also possible. In general, "buffer storage" can be understood to mean an operation, in the case of which at least one element is stored for a time period in a stationary or else movable manner, in order to subsequently further use said element, for example to transport it further.

The transport system is set up to selectively transfer the dirty items to be cleaned from the first conveying apparatus directly onto the second conveying apparatus, for example (a) by means of the transfer apparatus or else (b) without the use of the transfer apparatus, or to buffer store them in the buffer store, for example (a) without the use of the transfer apparatus or else (b) by means of the transfer apparatus, and subsequently to transfer them onto the second conveying apparatus, for example by means of the transfer apparatus. Thus, for example, the transport system can be set up to selectively transfer the dirty items to be cleaned from the first conveying apparatus by means of the transfer apparatus directly onto the second conveying apparatus, or to buffer store them in the buffer store without the use of the transfer apparatus, and subsequently to transfer them onto the second conveying apparatus, for example by means of the transfer apparatus. As an alternative, for example, the transport system can also be set up to selectively transfer the dirty items to be cleaned from the first conveying apparatus directly onto the second conveying apparatus without the use of the transfer apparatus, or to buffer store them in the buffer store by means of the transfer apparatus, and subsequently to transfer them onto the second conveying apparatus, for example by means of the transfer apparatus.

Here, the term "selectively" can be understood generally as a statement of suitability, in such a way that the transport system is set up and configured for both of the stated options, that is to say the option of the direct transfer onto the second conveying apparatus and the option of buffer storage. Which of the stated options is carried out can be stipulated, for example, manually and/or can also be determined automatically, for example by way of a controller of the cleaning system, as will be described in greater detail below.

For example, the transport system, for example the transfer apparatus, can be set up to transfer at least one certain type of dirty items to be cleaned. Said at least one type to be transferred can, for example, be stipulated or can be capable of being stipulated. Thus, for example, plates, crockery in general, glasses or cutlery can be transferred. Furthermore, at least one certain further type can be treated in such a way that it is at least not transferred directly, but rather first of all is buffer stored in the stated buffer store. As an alternative to a selection of the items to be cleaned which are to be transferred in accordance with the type of items to be cleaned, another selection can also be made, for example a selection by way of counting, for example by merely every third piece of items to be cleaned being transferred directly, whereas the rest are buffer stored in the buffer store, or a similar type of selection. As an alternative or in addition, once again, the cleaning system can also be configured in such a way that a transfer of the items to be cleaned from the first conveying apparatus to the second conveying apparatus takes place at certain times or under certain utilization conditions, whereas merely one part of the items to be cleaned is transferred from the first conveying apparatus onto the second conveying apparatus at other certain times or under other certain utilization conditions and the remaining part is buffer stored in the buffer store, or, as an alternative or in addition, once again, the items to be cleaned are buffer stored completely in the buffer store.

In general, therefore, the terms "at least one part of the dirty items to be cleaned" in features c. and d. can be understood to be suitability features, in such a way that there is the possibility (i) to completely transfer the items to be cleaned directly from the first conveying apparatus onto the second conveying apparatus;

(ii) to initially buffer store the items to be cleaned completely in the buffer store;

(iii) to transfer at least one first part quantity of the items to be cleaned directly from the first conveying apparatus onto the second conveying apparatus, whereas at least one second part quantity of the items to be cleaned is first of all buffer stored in the buffer store.

The term "at least one part of the dirty items to be cleaned" can therefore relate to at least one part quantity of the items to be cleaned which can be formed in accordance with certain criteria, it also fundamentally being possible for the part quantity to comprise the entire items to be cleaned. The selection as to which of the three stated options (i), (ii) and (iii) is to be implemented can take place manually by way of a user or else in a partially or fully automatic manner, for example on the basis of at least one sensor and/or on the basis of at least one stipulation by way of a controller, and/or can be stipulated by way of a user. An automatic selection can take place, for example, by means of at least one sensor and at least one controller, the sensor detecting, for example, a type and/or a degree of the utilization of the cleaning system, and the controller performing a corresponding selection of an option on the basis of the type and/or utilization, for example in accordance with stipulations in terms of program technology. For example, a utilization can be quantified on the basis of a number of pieces of items to be cleaned per unit time, which can be detected, for example, by means of an optical sensor, the controller selecting a corresponding option, for example on the basis of a table and/or a stipulated conversion or classification. As an alternative or in addition, for example, self-learning and/or self-optimizing systems and/or programs can also be used in the cleaning system, which systems and/or programs also detect, for example, times of the day or days of the week, and the controller performing a corresponding selection of an option, for example in accordance with stipulations in terms of program technology.

The above-described technical challenge can be reduced considerably by way of the use of the at least one buffer store, and more flexible manpower planning can be brought about. Thus, for example, the buffer store can be configured in such a way that, in the case of unforeseen utilization peaks, it receives at least one part of the items to be cleaned, with the result that an accumulation of items to be cleaned does not occur at the actual cleaning apparatus or else at an outlet of the cleaning apparatus. In this way, the same cleaning staff can alternate, for example, between an activity in an outlet region of the cleaning apparatus or the cleaning system and an activity in an inlet region of the cleaning apparatus or the cleaning system and/or also optional other activities, without a backlog occurring in the case of an unforeseen occurrence of a peak utilization. The manpower planning therefore no longer has to be aimed at a possible peak utilization on account of the buffer store which, in particular, can be used automatically. Therefore, the buffer store can generally be utilized for balancing of the utilization, with the result that manpower planning can be aimed, for example, at a mean utilization.

As described above, the transfer apparatus can comprise, in particular, at least one receiving element for receiving items to be cleaned. As used here, the term "receiving element" is a broad term which is to be given its customary and common meaning, as understood by a person skilled in the art. The term is not restricted to a specific or adapted meaning. The term can relate without restriction, in particular, to any desired element or any desired apparatus which are set up to receive at least one piece of items to be cleaned, for example to position it/them spatially in at least one, preferably two or even three dimensions or more. The receiving element can have, in particular, at least one element selected from the group consisting of: a gripper; a sucker; a magnet. As an alternative or in addition, other types of receiving elements might also be provided, in particular other types of actuators. As indicated above, the transfer apparatus can have at least one positioning apparatus for positioning the receiving element. Here, a positioning apparatus is generally to be understood to mean any desired apparatus which is set up to spatially position at least one element, for example in one, two, three or more dimensions. As indicated above, the at least one positioning apparatus can have, for example, at least one rail system, in order to position at least one actuator of the transfer apparatus in a spatially variable manner. As an alternative or in addition, the at least one positioning apparatus can also have at least one pivot axis, in order to position the at least one actuator in a variable manner in at least one spatial position. Other types of systems which make a spatial movement and/or positioning of an actuator possible are also conceivable, for example by means of at least one tripod.

As indicated above, the cleaning apparatus can comprise, in particular, at least one dishwasher. The dishwasher can be selected, in particular, from the group consisting of: a rack transport machine, a belt transport machine, a pass-through dishwasher, for example a hood-type dishwasher.

In particular, the cleaning apparatus can comprise at least one crockery dishwasher. The buffer store can comprise, in particular, at least one tray buffer store which is configured to receive a plurality of food trays. The tray buffer store can have, in particular, at least one sprung supporting surface, that is to say at least one supporting surface which is loaded with a spring force by way of at least one spring element. The sprung supporting surface can be set up, in particular, to hold in each case one uppermost food tray in a stack of food trays which are stacked on the supporting surface at a substantially constant height, regardless of the number of trays in the stack.

The first conveying apparatus and the second conveying apparatus can run offset in parallel with respect to one another, in particular, at least in a transfer region. Here, a transfer region can be understood generally to mean a spatial region which comprises at least one section of the first conveying apparatus, at least one section of the second conveying apparatus, and optionally also the transfer apparatus or a part thereof, the transfer apparatus being set up to perform the above-described transfer within the transfer region. The first conveying apparatus and the second conveying apparatus can be oriented parallel to one another at least in sections, in particular, in said transfer region. The transfer apparatus can be arranged at least partially in the transfer region and can be set up to transfer the items to be cleaned perpendicularly with respect to a conveying direction of the first conveying apparatus and perpendicularly with respect to a conveying direction of the second conveying apparatus from the first conveying apparatus to the second conveying apparatus. The first conveying direction and the second conveying direction therefore preferably form substantially a right angle in each case with a direction of the transfer, deviations of not more than 20°, in particular of not more than 10° or even of not more than 5° being tolerable, for example.

The buffer store can be arranged, in particular, at least partially in an extension of the first conveying apparatus in a conveying direction of the first conveying apparatus. Thus, for example, a section of the first conveying apparatus, from which section the transfer takes place, and a section of the second conveying apparatus, into which section the transfer takes place, and the buffer store can form a right-angled triangle. As an alternative or in addition, the buffer store can be arranged at least partially in an extension of the second conveying apparatus counter to a conveying direction of the second conveying apparatus. Here too, a section of the first conveying apparatus, from which section the transfer takes place, and a section of the second conveying apparatus, into which section the transfer takes place, and the buffer store can form a right-angled triangle. This configuration, in the case of which a section of the first conveying apparatus, from which section the transfer takes place, and a section of the second conveying apparatus, into which section the transfer takes place, and the buffer store form a right-angled triangle, can bring about one particularly simple embodiment of the transfer apparatus which can comprise, for example, a simple xyz-positioning system. A transfer into the buffer store can then be configured, for example, as a simple movement in the y-direction, whereas a transfer onto the second conveying apparatus can be configured as a simple movement in the x-direction.

As indicated above, the buffer store can be, in particular, of mobile configuration, for example as a transport trolley. Thus, for example, the buffer store can comprise at least one tray trolley. In particular, the buffer store can also be swapped temporarily, in particular when it is full.

As indicated above, the cleaning chamber can be configured, in particular, at least partially as a cleaning tunnel. The cleaning apparatus can have at least two cleaning zones, for example, in the cleaning tunnel, the transport system being set up to transport the items to be cleaned sequentially through the cleaning zones, in particular by means of the second conveying apparatus and/or a third conveying apparatus. The cleaning zones can comprise, in particular, at least two zones, selected from the group consisting of: a pre-clearing zone, a washing zone, a pump rinsing zone, a freshwater rinsing zone; a drying zone.

As indicated above, the cleaning apparatus can have, in particular, at least one third conveying apparatus which can be configured entirely or partially separately from the second conveying apparatus, or which can also be configured completely or partially together with the second conveying apparatus. Said third conveying apparatus can, for example, adjoin the second conveying apparatus directly or indirectly. The third conveying apparatus can be set up, in particular, to transport items to be cleaned through the cleaning chamber. Therefore, the third conveying apparatus can also be a constituent part of the cleaning apparatus and/or can also be conceptually assigned completely or partially to the transport system.

As has been mentioned above multiple times, furthermore, the cleaning system can comprise, in particular, at least one controller. The controller can be set up in terms of program technology to control operation of the transport system and optionally also of the cleaning apparatus. As used here, the term "controller" is a broad term which is to be given its customary and common meaning, as understood by a person skilled in the art. The term is not restricted to a specific or adapted meaning. The term can relate without restriction, in particular, to a single-piece or multiple-piece apparatus of the cleaning system or the cleaning apparatus, which apparatus is set up to completely or partially control and/or regulate operation of the cleaning system, in particular of the cleaning apparatus and/or the transport system. In particular, the controller can be set up to change, in particular to control and/or to regulate, one or more operating parameters of the cleaning system, for example at least one temperature, at least one pressure, at least one heat output, at least one transport speed or else a combination of two or more of said operating parameters. Here, the cleaning apparatus and the transport system can have separate controllers or else a common controller or else two or more coupled controllers. The controller can comprise, in particular, at least one data processing apparatus, for example at least one processor. The controller can be set up, in particular, in terms of program technology, for example, to control at least one cleaning program of the cleaning apparatus and optionally to control or to carry out the proposed method in one or more of the refinements which are mentioned in the following text. The set-up of the controller can be realized completely or partially by way of hardware and/or, as an alternative or in addition, completely or partially by way of software. Furthermore, the controller can comprise at least one volatile and/or non-volatile data memory. Furthermore, the controller can comprise at least one interface, for example a man-machine interface for the inlet of commands and/or for the output of information, and/or a wireless or wired interface for the unidirectional or bidirectional exchange of data and/or commands between the cleaning apparatus and at least one further apparatus. The controller can comprise, in particular, at least one computer and/or at least one processor. The controller can be, in particular, a central or local machine controller of the cleaning apparatus and/or the cleaning system and/or the transport system.

Furthermore, the cleaning system can have at least one sensor for the detection of items to be cleaned. Here, various possibilities can be realized under the term "detection". Thus, for example, a pure presence detection can take place, in the case of which it is merely detected that there are items to be cleaned. As an alternative or in addition, a type of the items to be cleaned can also be capable of being detected by means of the at least one sensor. In particular, the controller can be set up in terms of program technology to detect various degrees of utilization of the cleaning system on the basis of signals of the sensor, and to utilize the buffer store differently in accordance with the degrees of utilization. Thus, as indicated above, distinctions can be made, for example, with regard to options (i) to (iii) which are to be carried out.

In particular, the controller can be set up, for example in terms of program technology, to collect at least one part of the items to be cleaned automatically in the buffer store in the case of a high utilization and to transfer them subsequently onto the second conveying apparatus, for example in a collected manner A collected transfer can comprise, for example, that the individual parts of the items to be cleaned are transferred onto the second conveying apparatus without interruption, and the buffer store is therefore emptied.

Thus, for example, a current utilization can be quantified by way of a current frequency of delivery of items to be cleaned by way of the first conveying apparatus, for example quantified as a number of the pieces of items to be cleaned per minute. A "high utilization" can then be understood to mean, for example, a frequency which is greater than or at least equal to a predefined or predefinable threshold value. Thus, for example, relieving of the cleaning apparatus can take place at peak times, without a cleaning apparatus with a higher capacity being required. A standstill in the feed means can also be avoided.

As an alternative or in addition, the controller can also be set up, for example in terms of program technology, to collect at least one part of the items to be cleaned automatically in the buffer store in the case of a low utilization, and to subsequently transfer them onto the second conveying apparatus, for example in a collected manner. A "low utilization" can then be understood to mean, for example, a frequency which is less than or at most equal to a predefined or predefinable threshold value. In this case, for example, the presence of operating staff can be dispensed with, at least for a certain time period, by at least one part of the delivered items to be cleaned being buffer stored in the buffer store. After the time period of the buffer storage which can be predefined fixedly, can be capable of being predefined, or else can be adapted to the respective circumstances of the utilization, the transfer from the buffer store onto the second conveying apparatus can then take place, for example in a manner which is initiated manually or else automatically. For example, the time period of the buffer storage can be dimensioned in such a way that the transfer takes place when the collected items to be cleaned have reached a predefined quantity, in particular when the buffer store is full.

As indicated above, the optional at least one sensor can also be set up to distinguish between different types of items to be cleaned. Thus, for example, a distinction can take place between trays and other types of items to be cleaned. The controller can be set up, for example, to store at least one certain type of items to be cleaned, for example trays, in the buffer store. Other types of items to be cleaned can be transferred, for example, directly onto the second conveying apparatus.

Here, the sensor can implement one or more sensor principles. In particular, the sensor can comprise at least one sensor, selected from the group consisting of: an optical sensor; a camera; a metal detector; a light barrier; a mechanical sensing device; an electromagnetic sensor. If, for example, the sensor comprises at least one camera, the sensor itself and/or the controller can comprise, for example, at least one image detection software program which is set up to distinguish between at least two different types of items to be cleaned. For example, the controller can comprise at least one program technological algorithm for distinguishing between at least two types of items to be cleaned on the basis of image data. The controller can be trained, for example, for certain types of items to be cleaned and their detection, for example by said controller comprising at least one self-learning algorithm, for example at least one neural network. The controller of the transfer apparatus can be adapted, for example, to the detected type of items to be cleaned. In particular, a selection can also take place on the basis of the detected type of items to be cleaned as to whether a transfer takes place into the buffer store or onto the second conveying apparatus. Furthermore, the controller can also be set up, for example, in such a way that the transfer apparatus is adapted to the type of detected items to be cleaned. Thus, for example, a selection of a suitable receiving element for the type of items to be cleaned can take place automatically. For example, a sucker can be used for plates or other types of crockery, whereas a magnet can be used for cutlery. A gripper can be used, for example, for trays.

In a further aspect, a method for cleaning items to be cleaned is proposed. The method comprises the steps which are mentioned in greater detail below. Said steps can be carried out in the indicated sequence. Another sequence is also fundamentally possible, however. Furthermore, two or more of said method steps can be carried out so as to overlap temporally or at the same time. Furthermore, one or more of said method steps can be carried out once or else repeatedly. Beyond said steps, the method can comprise further method steps which are not mentioned.

The method comprises the following steps:

I. providing of at least one cleaning system as proposed in the present case, for example in accordance with one or more of the above-described embodiments and/or in accordance with one or more of the embodiments which are described in greater detail below;

II. delivery of dirty items to be cleaned by means of the first conveying apparatus;

III. transfer of at least one part of the dirty items to be cleaned, in particular by means of the transfer apparatus, the transfer taking place either directly from the first conveying apparatus onto the second conveying apparatus, or from the first conveying apparatus onto the second conveying apparatus after buffer storage in the buffer store.

Reference can be made to the above description of the cleaning system for further possible embodiments, definitions or options.

In particular, the method can be configured in such a way that a distinction is made between at least two types of dirty items to be cleaned. At least one first type of dirty items to be cleaned can be transferred directly from the first conveying apparatus onto the second conveying apparatus, and at least one second type of dirty items to be cleaned can be transferred from the first conveying apparatus onto the second conveying apparatus after buffer storage in the buffer store.

In general, the transfer can take place, in particular, in such a way that, during phases with a high quantity of dirty items to be cleaned, for example once again in the case of at least one threshold value of the frequency of the delivery of items to be cleaned and/or a certain type of items to be cleaned being exceeded, at least one part of the dirty items to be cleaned is stored in the buffer store and is subsequently transferred, for example in a collected manner, onto the second conveying apparatus. As an alternative or in addition, as indicated above, during phases with a low quantity of dirty items to be cleaned, for example once again in the case of at least one threshold value of the frequency of the delivery of items to be cleaned and/or a certain type of items to be cleaned being undershot, at least one part of the dirty items to be cleaned can be stored in the buffer store and can subsequently be transferred, for example in a collected manner, onto the second conveying apparatus.

In particular, operation of the cleaning apparatus can be synchronized with the transfer of the dirty items to be cleaned. Thus, for example, the cleaning apparatus and/or operation of the loading apparatus can be switched in such a way that the loading takes place merely when there are actually also items to be cleaned in the cleaning apparatus. In this way, resources, in particular energy and/or consumables such as, for example, cleaning liquid, can be saved and can be adapted to the actual requirement. The synchronization can take place automatically, in particular. Furthermore, the synchronization can also comprise an adaptation of a program selection. For example, first of all exclusively crockery can be transferred onto the second conveying apparatus, whereas, for example, trays are first of all buffer stored in the buffer store. Here, the cleaning apparatus can be set, for example, to at least one special crockery program. Subsequently, the trays can then be transferred from the buffer store onto the second conveying apparatus, and the cleaning apparatus can then be set, for example, to at least one special tray program. During this time, for example, the first conveying apparatus can be switched off, can be switched to a lower speed, or else, in particular in the case of a low quantity of dirty items to be cleaned, can run further at the previous speed.

Overall, therefore, the proposed cleaning system and the proposed method make the realization of a multiplicity of advantages possible. In particular, considerably more flexible manpower planning can take place, since operating staff do not always have to be provided in the inlet region of the cleaning apparatus. In addition, other saving possibilities can also be utilized, for example by way of a higher degree of automation or also by way of an adaptation of operation of the cleaning apparatus to the items to be cleaned which are actually currently present, including the possibility of a phased switch-off, the possibility of a reduction of operation, or else the possibility of a selection of a suitable program. Furthermore, smaller dimensions of the hardware of the cleaning system can also be achieved by way of the proposed cleaning system and the proposed method. In an analogous manner with respect to the manpower planning, the components of the cleaning system have to be adapted as a rule, in the case of conventional cleaning systems, to a peak load which is to be expected. This means, in particular, that cleaning apparatuses which are as a rule oversized have to be used. By way of the possibility of the use of at least one buffer store, however, at least one buffer can be provided which can intercept a transiently occurring peak load without it being necessary for the dimensioning of the cleaning apparatus itself to be adapted to said peak load. As a result, considerable savings can be achieved with regard to the complexity, the space requirement and the costs of the cleaning system.

In summary, without restriction of further possible configurations, the following embodiments are proposed:

Embodiment 1: cleaning system for cleaning items to be cleaned, comprising a) at least one cleaning apparatus, having at least one at least partially closed cleaning chamber with at least one loading apparatus for loading the items to be cleaned with at least one cleaning liquid; and b) at least one transport system for the automatic transport of the items to be cleaned, the transport system comprising:

a. at least one first conveying apparatus for the delivery of dirty items to be cleaned;

b. at least one second conveying apparatus for the transport of the dirty items to be cleaned to the cleaning apparatus;

c. at least one transfer apparatus for the transfer of at least one part of the dirty items to be cleaned from the first conveying apparatus onto the second conveying apparatus; and d. at least one buffer store for the buffer storage of at least one part of the dirty items to be cleaned, the transport system being set up to selectively transfer the dirty items to be cleaned from the first conveying apparatus directly onto the second conveying apparatus, for example by means of the transfer apparatus or else without use of the transfer apparatus, or to buffer store them in the buffer store, for example by means of the transfer apparatus or else without use of the transfer apparatus, and subsequently to transfer them onto the second conveying apparatus, for example by means of the transfer apparatus.

Embodiment 2: cleaning system in accordance with the preceding embodiment, the transfer apparatus comprising at least one receiving element for receiving items to be cleaned.

Embodiment 3: cleaning system in accordance with the preceding embodiment, the receiving element having at least one element, selected from the group consisting of: a gripper; a sucker; a magnet.

Embodiment 4: cleaning system in accordance with any one of the preceding embodiments, the transfer apparatus having at least one positioning apparatus for positioning the receiving element.

Embodiment 5: cleaning system in accordance with any one of the preceding embodiments, the cleaning apparatus comprising at least one dishwasher.

Embodiment 6: cleaning system in accordance with the preceding embodiment, the dishwasher being selected from the group consisting of: a rack transport machine, a belt transport machine, a pass-through dishwasher, for example a hood-type dishwasher.

Embodiment 7: cleaning system in accordance with any one of the preceding embodiments, the cleaning apparatus comprising at least one crockery dishwasher, the buffer store comprising at least one tray buffer store, the tray buffer store being configured to receive a plurality of food trays.

Embodiment 8: cleaning system in accordance with any one of the preceding embodiments, the tray buffer store having a sprung supporting surface.

Embodiment 9: cleaning system in accordance with the preceding embodiment, the sprung supporting surface being set up to hold in each case one uppermost food tray in a stack of food trays which is stacked on the supporting surface at a constant height, regardless of the number of trays in the stack.

Embodiment 10: cleaning system in accordance with any one of the preceding embodiments, the first conveying apparatus and the second conveying apparatus running offset in parallel with respect to one another at least in a transfer region.

Embodiment 11: cleaning system in accordance with the preceding embodiment, the transfer apparatus being arranged at least partially in the transfer region and being set up to transfer the items to be cleaned from the first conveying apparatus to the second conveying apparatus perpendicularly with respect to a conveying direction of the first conveying apparatus and perpendicularly with respect to a conveying direction of the second conveying apparatus.

Embodiment 12: cleaning system in accordance with any one of the preceding embodiments, the buffer store being arranged at least partially in an extension of the first conveying apparatus in a conveying direction of the first conveying apparatus.

Embodiment 13: cleaning system in accordance with any one of the preceding embodiments, the buffer store being arranged at least partially in an extension of the second conveying apparatus counter to a conveying direction of the second conveying apparatus.

Embodiment 14: cleaning system in accordance with any one of the preceding embodiments, the buffer store being of mobile configuration, in particular as a transport trolley.

Embodiment 15: cleaning system in accordance with any one of the preceding embodiments, the cleaning chamber being configured at least partially as a cleaning tunnel.

Embodiment 16: cleaning system in accordance with the preceding embodiment, the cleaning apparatus having at least two cleaning zones in the cleaning tunnel, the transport system being set up to transport the items to be cleaned sequentially through the cleaning zones, in particular by means of the second conveying apparatus.

Embodiment 17: cleaning system in accordance with the preceding embodiment, the cleaning zones comprising at least two zones, selected from the group consisting of: a pre-clearing zone, a washing zone, a pump rinsing zone, a freshwater rinsing zone; a drying zone.

Embodiment 18: cleaning system in accordance with any one of the preceding embodiments, the cleaning apparatus having at least one third conveying apparatus, the third conveying apparatus being set up to transport items to be cleaned through the cleaning chamber.

Embodiment 19: cleaning system in accordance with any one of the preceding embodiments, the cleaning system comprising, furthermore, a controller, the controller being set up in terms of program technology to control operation of the cleaning system.

Embodiment 20: cleaning system in accordance with the preceding embodiment, comprising, furthermore, at least one sensor for the detection of items to be cleaned.

Embodiment 21: cleaning system in accordance with the preceding embodiment, the controller being set up in terms of program technology to detect various degrees of utilization of the cleaning system on the basis of signals of the sensor, and to use the buffer store differently in accordance with the degrees of utilization.

Embodiment 22: cleaning system in accordance with the preceding embodiment, the controller being set up to automatically collect at least one part of the items to be cleaned in the buffer store in the case of a high utilization, and to subsequently transfer them onto the second conveying apparatus.

Embodiment 23: cleaning system in accordance with the preceding embodiment, the transfer taking place when the collected items to be cleaned have reached a predefined quantity.

Embodiment 24: cleaning system in accordance with any one of the four preceding embodiments, the sensor being set up to distinguish between different types of items to be cleaned, the controller being set up to store at least one certain type of items to be cleaned in the buffer store.

Embodiment 25: cleaning system in accordance with any one of the five preceding embodiments, the sensor comprising at least one sensor, selected from the group consisting of: an optical sensor; a camera; a metal detector; a light barrier; a mechanical sensing device; an electromagnetic sensor.

Embodiment 26: method for cleaning items to be cleaned, with the following method steps:

I. providing of at least one cleaning system in accordance with any one of the preceding embodiments;

II. delivery of dirty items to be cleaned by means of the first conveying apparatus;

III. transfer of at least one part of the dirty items to be cleaned, for example by means of the transfer apparatus, the transfer taking place either directly from the first conveying apparatus onto the second conveying apparatus, or from the first conveying apparatus onto the second conveying apparatus after buffer storage in the buffer store.

Embodiment 27: method in accordance with the preceding embodiment, at least two types of dirty items to be cleaned being differentiated, at least one first type of dirty items to be cleaned being transferred directly from the first conveying apparatus onto the second conveying apparatus, and at least one second type of dirty items to be cleaned being transferred from the first conveying apparatus onto the second conveying apparatus after buffer storage in the buffer store.

Embodiment 28: method in accordance with any one of the preceding embodiments which relate to a method, the transfer taking place in such a way that, during phases with a high quantity of dirty items to be cleaned, at least one part of the dirty items to be cleaned is stored in the buffer store and is subsequently transferred, in a collected manner, onto the second conveying apparatus.

Embodiment 29: method in accordance with the preceding embodiment, operation of the cleaning apparatus being synchronized with the collected transfer of the dirty items to be cleaned.

BRIEF DESCRIPTION OF THE FIGURES

Further details and features result from the following description of exemplary embodiments, in particular in conjunction with the subclaims. Here, the respective features can be implemented per se on their own or combined severally with one another. The invention is not restricted to the exemplary embodiments. The exemplary embodiments are shown diagrammatically in the figures. Here, identical designations in the individual figures denote identical or functionally identical elements or elements which correspond to one another with respect to their functions.

In the drawing, in detail.

DESCRIPTION OF THE EXEMPLARY EMBODIMENTS

Figure 1:
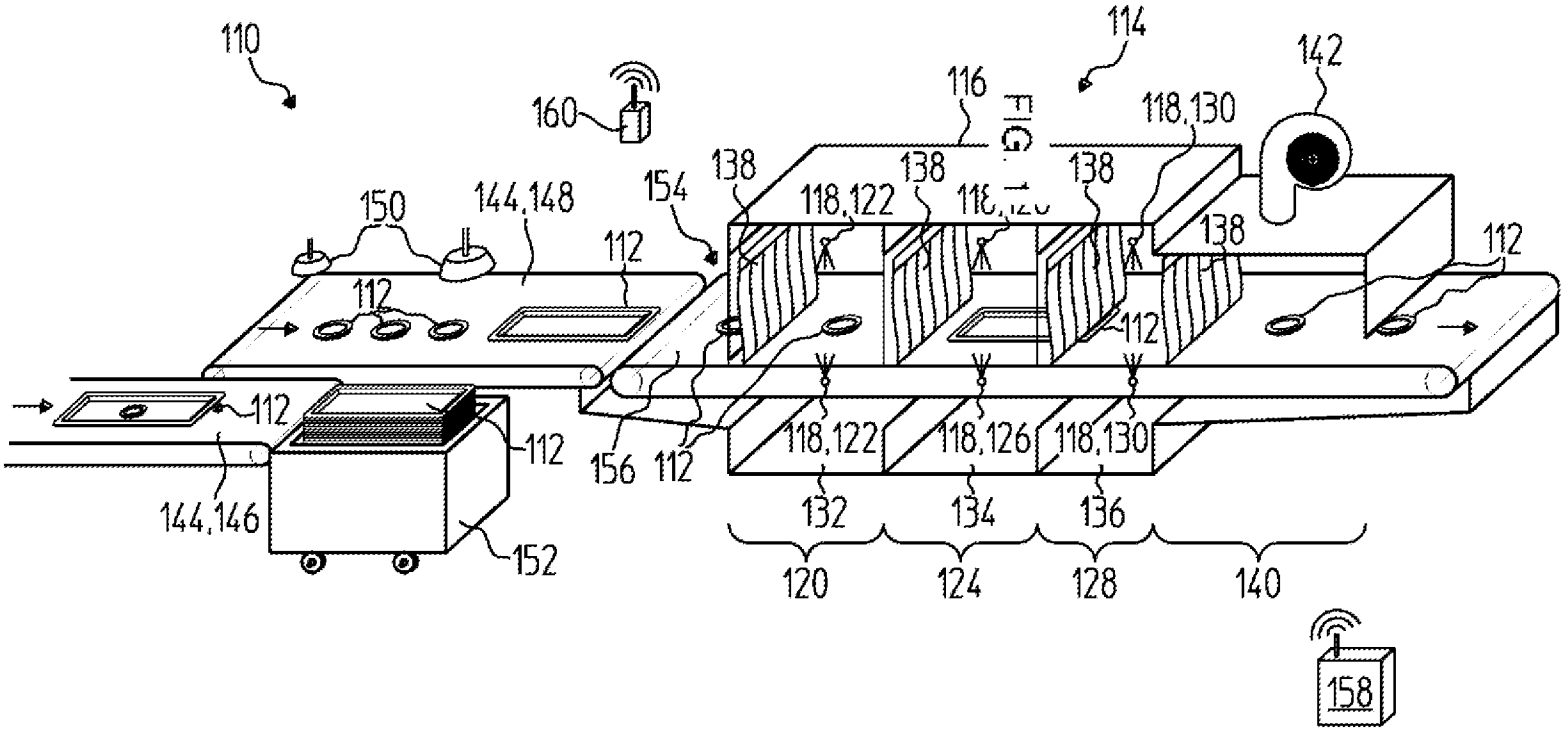
FIG. 1 shows one exemplary embodiment of a cleaning system in a perspective view.

FIG. 1 illustrates one exemplary embodiment of a cleaning system 110 in a perspective view. The cleaning system 110 is set up, in particular, to clean items to be cleaned 112, and comprises at least one cleaning apparatus 114. Here, the cleaning apparatus 114 comprises at least one at least partially closed cleaning chamber 116 with at least one loading apparatus 118 for loading the items to be cleaned 110 with at least one cleaning liquid. Here, the cleaning chamber 116 of the cleaning apparatus 114 can be configured, for example, as a cleaning tunnel, as is illustrated in FIG. 1. Here, the cleaning tunnel can have, for example, a plurality of cleaning zones. For example, the items to be cleaned 112 can first of all be cleaned roughly in a pre-clearing zone 120. For example, a pre-clearing nozzle system 122 which can be part of the loading apparatus 118 can be situated within the pre-clearing zone 120. The pre-clearing zone 122 can be adjoined by a washing zone 124, within which, for example, at least one main cleaning nozzle system 126 can be situated which can likewise be part of the loading apparatus 118. The pre-clearing zone can be adjoined, for example, by a rinsing zone 128 which, for example, can be divided into a pump rinsing zone and a freshwater rinsing zone. A rinsing nozzle system 130, for example a pump rinsing nozzle system and/or a freshwater rinsing nozzle system, can be situated within the rinsing zone 128, for example. The nozzle systems 122, 126 and 130 can be loaded with cleaning fluid, for example, via pumps (not shown in FIG. 1) from corresponding tanks 132 to 136. The cleaning zones 120, 124 and 128 can be separated among one another and/or toward the outside in each case by way of curtains 138. The cleaning zones 120, 124 and 128 can be adjoined, for example, by at least one drying zone 140. In the latter, the items to be cleaned 112 can be loaded with air, preferably with heated air, in particular by means of a fan 142, for example in order to dry the items to be cleaned 112.

In addition, the cleaning system 110 has a transport system 144 for the automatic transport of the items to be cleaned 112. The transport system 144 comprises at least one first conveying apparatus 146 for the delivery of dirty items to be cleaned 112. Furthermore, the transport system 144 comprises at least one second conveying apparatus 148 for the transport of the dirty items to be cleaned 112 to the cleaning apparatus 114. Furthermore, the transport system 144 comprises at least one transfer apparatus 150 for the transfer of at least one part of the dirty items to be cleaned 112 from the first conveying apparatus 146 onto the second conveying apparatus 148. In addition, the transport system 144 comprises at least one buffer store 152 for the buffer storage of at least one part of the dirty items to be cleaned 112. In particular, the transport system 144 is set up to selectively transfer the dirty items to be cleaned 112 from the first conveying apparatus 146 directly onto the second conveying apparatus 148, or to buffer store them in the buffer store 152 and to subsequently transfer them onto the second conveying apparatus 148. For example, the second conveying apparatus 148 can be set up to transport the dirty items to be cleaned 112 to the cleaning apparatus 114, for example to an inlet region 154 of the cleaning apparatus 114. In particular, the cleaning apparatus 114 can optionally comprise at least one third conveying apparatus 156 which is set up to transport the items to be cleaned 112 through the cleaning chamber 116. The cleaning system 110 can be set up to transfer the items to be cleaned 112 from the second conveying apparatus 148 onto the third conveying apparatus 156, for example by the second conveying apparatus 148 adjoining the third conveying apparatus 156, with the result that the items to be cleaned 112 are transferred directly or else indirectly from the second conveying apparatus 148 onto the third conveying apparatus 156, as illustrated in FIG. 1, for example. In particular, a conveying direction of the respective conveying apparatuses 146, 148 and 156 can be illustrated in the figures by way of arrows.

Furthermore, the cleaning system 110 can have a controller 158. The controller 158 can be set up in terms of program technology, in particular, to control operation of the cleaning system 110. For example, furthermore, the cleaning system 110 can comprise at least one sensor 160 for the detection of items to be cleaned 112. For example, the controller 158 can be set up in terms of program technology to detect various degrees of utilization of the cleaning system 110 on the basis of signals of the sensor 160, and to utilize the buffer store 152 differently in accordance with the degrees of utilization. In particular, the controller 158 can be set up, for example, to automatically collect at least one part of the items to be cleaned 112 in the buffer store 152 in the case of a high utilization, for example in order to subsequently transfer the items to be cleaned 112, in a collected manner, onto the second conveying apparatus 148, in particular when the collected items to be cleaned 112 have reached a predefined quantity. Furthermore, the sensor 160 can be set up to distinguish between different types of items to be cleaned 112. For example, the controller 158 is set up to store at least one certain type of items to be cleaned, for example trays as shown in FIG. 1, in the buffer store 152.

Figure 2:
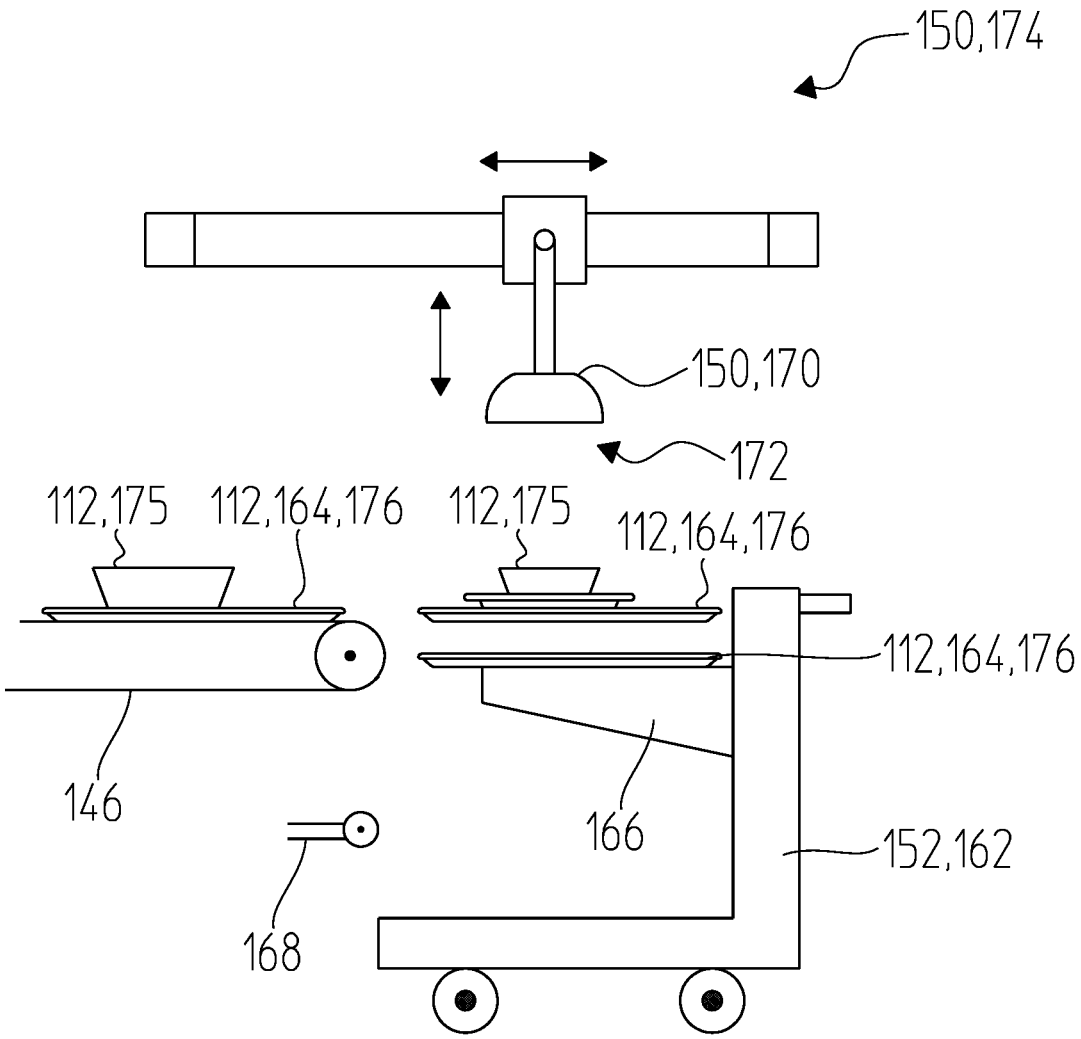
FIG. 2 shows a detail from one exemplary embodiment of a cleaning system in a front view.

FIG. 2 shows a detail from one exemplary embodiment of a cleaning system 110. In particular, one exemplary embodiment of the buffer store 152, in particular a tray buffer store 162, is illustrated in a front view, it being possible for the tray buffer store to be configured to receive a plurality of food trays 164. In particular, the tray buffer store 162 can have, for example, a sprung supporting surface 166. For example, the sprung supporting surface 166 can be set up to hold in each case one uppermost food tray 164 in a stack of food trays 164 which is stacked on the supporting surface 166 at a constant height, in particular regardless of the number of food trays 164 in the stack; for example, at the level of the first conveying apparatus 146, with the result that an automatic transfer of the items to be cleaned 112 from the first conveying apparatus 146 into the tray buffer store 162 can take place. For example, the tray buffer store 162 can have a sensor 168 which can be set up, for example, to detect a filling level of the tray buffer store 162. In particular, a swap of the tray buffer store 162 can be initiated by means of the sensor 168, for example by way of the controller 158. As an alternative, it can preferably be initiated with the aid of the controller 158 that, for example, the food trays 164 are transferred onto the second conveying apparatus 148 by means of the transfer apparatus 150, in order to empty the tray buffer store 162 completely or partially in the short term.

The transfer apparatus 150 can comprise, in particular, at least one receiving element 170 for receiving the items to be cleaned 112. In particular, the receiving element 170 can have, for example, at least one sucker 172 for this purpose. For example, the sucker 172 can receive the items to be cleaned 112, in particular by way of generation of a negative pressure.

Figure 3:
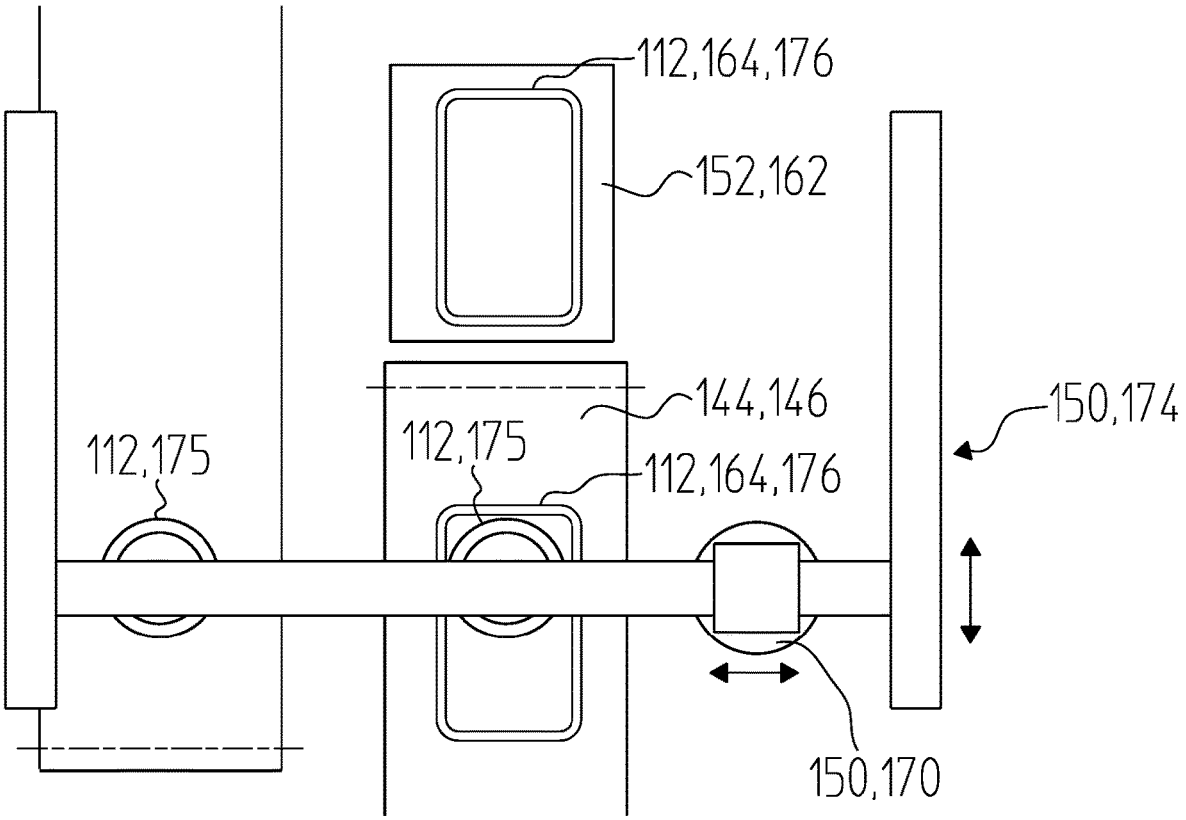
FIG. 3 shows a detail from one exemplary embodiment of a cleaning system in a plan view.

Furthermore, the transfer apparatus 150 can have at least one positioning apparatus 174 for positioning the receiving element 170. For example, as illustrated in FIGS. 2 and 3, the positioning apparatus 174 can have a rail system, in order to position the receiving element 170 spatially, for example by way of movement of the receiving element 170 in the directions which are symbolized by way of arrows.

In particular, a distinction can be made, for example, between at least two types of dirty items to be cleaned. For example, a first type 175 of dirty items to be cleaned 112 can be transferred directly from the first conveying apparatus 146 onto the second conveying apparatus 148. For example, a second type 176 of dirty items to be cleaned 112 can be transferred from the first conveying apparatus 146 onto the second conveying apparatus 148 after buffer storage in the buffer store 152.

Figure 4:
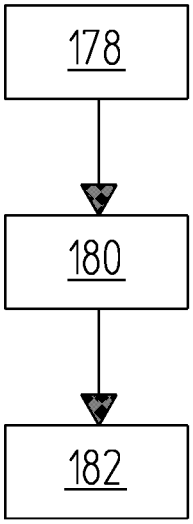
FIG. 4 shows a flow chart of one exemplary embodiment of a method for cleaning items to be cleaned.

FIG. 4 shows a flow chart of one exemplary embodiment of a method for cleaning items to be cleaned 112. The method comprises the following method steps:

I. (labeled by way of designation 178) providing of at least one cleaning system 110 as proposed in the present case, for example in accordance with one or more of the embodiments which are described in greater detail above or below;

II. (labeled by way of designation 180) delivery of dirty items to be cleaned 112 by means of the first conveying apparatus 146;

III. (labeled by way of designation 182) transfer of at least one part of the dirty items to be cleaned 112, in particular by means of the transfer apparatus 150, the transfer taking place either directly from the first conveying apparatus 146 onto the second conveying apparatus 148, or from the first conveying apparatus 146 onto the second conveying apparatus 148 after buffer storage in the buffer store 152.

For example, the transfer, in particular in method step III., can take place in such a way that, during phases with a high quantity of dirty items to be cleaned 112, at least one part of the dirty items to be cleaned 112, for example in a manner which is sorted according to the type, for example separated in each case according to a first type 175 and a second type 176, is stored in the buffer store 152. Thus, for example, in phases, in which the quantity of dirty items to be cleaned 112 lies above a threshold value for a frequency of a delivery of dirty items to be cleaned 112, for example in a manner which is dependent on a cleaning line of the cleaning apparatus 114, at least one part of the dirty items to be cleaned 112 can be buffer stored. Subsequently, for example, a transfer of the collected dirty items to be cleaned 112 onto the second conveying apparatus 148 can take place. For example, operation of the cleaning apparatus can be synchronized with the collected transfer of the dirty items to be cleaned 112.

LIST OF REFERENCE SIGNS

110 Cleaning system
112 Items to be cleaned
114 Cleaning apparatus
116 Cleaning chamber
118 Loading apparatus
120 Pre-clearing zone
122 Pre-clearing nozzle system
124 Washing zone
126 Main cleaning nozzle system
128 Rinsing zone
130 Rinsing nozzle system
132 Tank
134 Tank
136 Tank
138 Curtain
140 Drying zone
142 Fan
144 Transport system
146 First conveying apparatus
148 Second conveying apparatus
150 Transfer apparatus
152 Buffer store
154 Inlet region
156 Third conveying apparatus
158 Controller
160 Sensor
162 Tray buffer store
164 Food tray
166 Supporting surface
168 Sensor
170 Receiving element
172 Sucker
174 Positioning apparatus
175 First type of dirty items to be cleaned
176 Second type of dirty items to be cleaned
178 Step I.: providing of at least one cleaning system
180 Step II.: delivery of dirty items to be cleaned by means of the first conveying apparatus
182 Step III.: transfer of at least one part of the dirty items to be cleaned by means of the transfer apparatus

The invention claimed is:

1. A cleaning system for cleaning items to be cleaned, comprising a) at least one cleaning apparatus, having at least one at least partially closed cleaning chamber with at least one loading apparatus for loading the items to be cleaned with at least one cleaning liquid; and b) at least one transport system for the automatic transport of the items to be cleaned, the transport system comprising:

a. at least one first conveying apparatus for the delivery of dirty items to be cleaned;

b. at least one second conveying apparatus for the transport of the dirty items to be cleaned to the cleaning apparatus;

c. at least one transfer apparatus for the transfer of at least one part of the dirty items to be cleaned from the first conveying apparatus onto the second conveying apparatus; and d. at least one buffer store for the buffer storage of at least one part of the dirty items to be cleaned, the transport system being set up to selectively transfer the dirty items to be cleaned from the first conveying apparatus directly onto the second conveying apparatus by means of the transfer apparatus, or to buffer store them in the buffer store and to subsequently transfer them onto the second conveying apparatus by means of the transfer, apparatus.

2. The cleaning system as claimed in claim 1, the transfer apparatus comprising at least one receiving element for receiving items to be cleaned.

3. The cleaning system as claimed in claim 2, the receiving element having at least one element, selected from the group consisting of: a gripper; a sucker; a magnet.

4. The cleaning system as claimed in claim 2, the transfer apparatus having at least one positioning apparatus for positioning the receiving element.

5. The cleaning system as claimed in claim 1, the cleaning apparatus comprising at least one dishwasher, the buffer store comprising at least one tray buffer store, the tray buffer store being configured to receive a plurality of food trays.

6. The cleaning system as claimed in claim 1, the first conveying apparatus and the second conveying apparatus running offset in parallel with respect to one another at least in a transfer region, the transfer apparatus being arranged at least partially in the transfer region and being set up to transfer the items to be cleaned perpendicularly with respect to a conveying direction of the first conveying apparatus and perpendicularly with respect to a conveying direction of the second conveying apparatus from the first conveying apparatus to the second conveying apparatus.

7. The cleaning system as claimed in claim 1, the cleaning chamber being configured at least partially as a cleaning tunnel, the cleaning apparatus having at least two cleaning zones in the cleaning tunnel, the transport system being set up to transport the items to be cleaned sequentially through the cleaning zones.

8. The cleaning system as claimed in claim 1, the cleaning apparatus having at least one third conveying apparatus, the third conveying apparatus being set up to transport items to be cleaned through the cleaning chamber.

9. The cleaning system as claimed in claim 1, the cleaning system comprising, furthermore, a controller, the controller being set up in terms of program technology to control operation of the cleaning system.

10. The cleaning system as claimed in claim 9, comprising, furthermore, at least one sensor for the detection of items to be cleaned, the controller being set up in terms of program technology to detect various degrees of utilization of the cleaning system on the basis of signals of the sensor, and to use the buffer store differently in accordance with the degrees of utilization.

11. The cleaning system as claimed in claim 10, the controller being set up to collect at least one part of the items to be cleaned automatically in the buffer store in the case of a high utilization, and to subsequently transfer them in a collected manner onto the second conveying apparatus.

12. The cleaning system as claimed in claim 10, the sensor being set up to distinguish between different types of items to be cleaned, the controller being set up to store at least one certain type of items to be cleaned in the buffer store.

13. A method for cleaning items to be cleaned, with the following method steps:

I. providing of at least one cleaning system as claimed in claim 1;

II. delivery of dirty items to be cleaned by means of the first conveying apparatus;

III. transfer of at least one part of the dirty items to be cleaned, the transfer taking place either directly from the first conveying apparatus onto the second conveying apparatus, or from the first conveying apparatus onto the second conveying apparatus after buffer storage in the buffer store.

14. The method as claimed in claim 13, a distinction being made between at least two types of dirty items to be cleaned, at least one first type of dirty items to be cleaned being transferred directly from the first conveying apparatus onto the second conveying apparatus, and at least one second type of dirty items to be cleaned being transferred from the first conveying apparatus onto the second conveying apparatus after buffer storage in the buffer store.

15. The method as claimed in claim 13, the transfer taking place in such a way that, during phases when a quantity of dirty items to be cleaned exceeds at least one threshold, at least one part of the dirty items to be cleaned is stored in the buffer store and is subsequently transferred in a collected manner onto the second conveying apparatus, operation of the cleaning apparatus being synchronized with the collected transfer of the dirty items to be cleaned.

* * * * *